US012129599B2

(12) United States Patent
Enzor et al.

(10) Patent No.: US 12,129,599 B2
(45) Date of Patent: Oct. 29, 2024

(54) PRESSURE SCREEN FOR A FIBER WEB PRODUCT PROCESS WITH REMOVABLE COVER

(71) Applicant: Valmet Technologies, Inc., Espoo (FI)

(72) Inventors: Steve Enzor, Norcross, GA (US); Bryson Hepler, Nashua, NH (US); Robert Short, Nashua, NH (US)

(73) Assignee: Valmet Technologies, Inc., Espoo (FI)

( * ) Notice: Subject to any disclaimer, the term of this patent is extended or adjusted under 35 U.S.C. 154(b) by 0 days.

(21) Appl. No.: 18/236,485

(22) Filed: Aug. 22, 2023

(65) Prior Publication Data

US 2024/0068162 A1 Feb. 29, 2024

Related U.S. Application Data

(60) Provisional application No. 63/402,349, filed on Aug. 30, 2022.

(51) Int. Cl.
*D21F 1/00* (2006.01)
*D21H 11/14* (2006.01)

(52) U.S. Cl.
CPC ..... *D21F 1/0027* (2013.01); *D21H 11/14* (2013.01)

(58) Field of Classification Search
CPC ..... D21F 1/0027; D21H 11/14; D21D 5/026; B07B 1/20
See application file for complete search history.

(56) References Cited

U.S. PATENT DOCUMENTS 4,880,540 A * 11/1989 Frejborg ..... B01D 29/945 209/273
6,241,102 B1 * 6/2001 Lindberg ..... B07B 1/20 210/414
2019/0352966 A1 * 11/2019 Leung ..... F16C 33/121
2023/0234075 A1 * 7/2023 Piramoon ..... B04B 7/085 494/37

* cited by examiner

*Primary Examiner* — Michael Collins
*Assistant Examiner* — Miraj T. Patel
(74) *Attorney, Agent, or Firm* — Stiennon & Stiennon

(57) ABSTRACT

A pressure screen for use in a fiber web product process (10) has an inlet zone (12), a basket having an accept zone (14) and a reject zone (20). The pressure screen (10) has a housing (28) inside which a rotor (27) is located. The reject zone (20) of the pressure screen (10) has a cover (22) forming a rejects chamber (21) for the reject zone (20). The cover (22) of the rejects chamber (21) of the screen (10) is removable by a reopenable attachment means (25, 29) attached to the housing (28) of the screen (10).

19 Claims, 3 Drawing Sheets

PRESSURE SCREEN FOR A FIBER WEB PRODUCT PROCESS WITH REMOVABLE COVER

CROSS REFERENCES TO RELATED APPLICATIONS

This application claims priority on U.S. Patent App. No. 63/402,349, filed Aug. 30, 2022, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to screens for screening fluid and solid mixtures, especially in connection with pulp and fiber web production.

As known from the prior art in fiber web machines, especially in paper and board machines, the fiber web is produced and treated in an assembly formed by a number of apparatuses arranged consecutively in a process line. A typical production and treatment line comprises a forming section comprising a head box and a forming unit and a press section as well as a subsequent drying section and a reel-up. The production and treatment line can further comprise other devices and sections for finishing the fiber web, for example, a size press, a calender, a coating section. The production and treatment line also comprises typically at least one winder for forming customer rolls as well as a roll packaging apparatus.

Before the head box, pulp suspensions comprising recycled or virgin fiber are treated to be fed into the head box to be used to produce the fiber webs. A treatment system of the pulp suspensions for example comprises a pulping section, a deashing system, a detrashing system, a coarse screening section, a centrifugal cleaning section, a fractionation section, a fine screening system, a fiber thickening system and fiber refining systems.

Screening is used for removing stickies, dirt specks and other impurities from the pulp suspension and for maximizing accept pulp quality and for ensuring constant runnability of the fiber web production process and for minimizing fiber losses in the pulp suspension treatment before the forming section and for minimizing breakdown of impurities and for protecting the following process stages in the fiber web production. Screening is used in connection with pulp suspension treatment for pulp suspension comprising recycled fiber and/or virgin fiber. In treatment of pulp suspensions comprising recycled fiber, screening is used in OCC line screening processes, in DIP line screening processes and in stock preparation. In treatment of pulp suspensions comprising virgin fiber, screening is used in chemical pulping, mechanical pulping and in stock preparation. Depending on the type of the impurity, the composition of the pulp suspension varies but generally impurities to be removed by screening are metals, sand, plastics, rubber, waxes, glass, stickies, ink, bark, pitch, shives, knots, rust, chemicals, robe and/or fiber bundles.

Screens are also used in connection with dispersing devices for screening, for example, mixtures of pigment slurries, coating colors, starch etc. In connection with the fiber web production, for example in connection with paper or board web production, different kinds of mixtures, for example pigment slurries and coating pastes, are used to coat the web. The mixtures are of different compositions and have different kinds of dry substances i.e. solids and liquid, for example water, and they are typically prepared for each specific use. To achieve high quality of the coated web these mixtures are to be screened. Generally, the primary screening is done to the mixture as part of the mixture preparing but additionally screens are arranged to coating stations in connection with the mixture feed circulation. The purpose of screening is to separate from the coating mixture dry substance accumulations, fibers detached from the web and other foreign matter that would cause coating defects.

In the screening different types of screening devices are used. The present invention relates to pressure screens, for example to under trade name M-RTM by the applicant marketing pressure screens, which are mainly used for furnishing applications ranging from virgin pulps to secondary fibers. The present invention relates in particular to screening of pulps comprising recycled fiber materials in which pressure screen stock flow is from the inner diameter to the outer diameter of the basket of the screen and the rotor is used to fluidize the pulp slurry on the inner diameter of the basket. The internal shell of the screen has three functional zones: an inlet zone, a basket and accept zone and a reject zone. The present invention relates to improvement of the reject zone. In the inlet zone heavy tramp material is removed prior to the screening of the pulp slurry. In the basket and accept zone from the fiber slurry then entering the screening zone, by means of the differential pressure between the interior of the screen and the accepts chamber the acceptable fibers are passed through the screen basket and into the accept zone and accepted fibers are discharged through the outlet located midway on the shell. In the reject zone material which does not pass through the screen basket will be discharged through the light debris outlet, which outlet is differentiated from the tramp discharge, ("heavy" rejects outlet), by the description of "light" rejects outlet. In the screens known from the prior art the rejects chamber for the screen is a fabricated section welded in place or a cast dished shaped chamber welded in place. As the surfaces of the rejects chambers wear in the process, especially due to the recycled fiber material, there exists a need to repair them either in place, which may cause a long shutdown of the process for the duration of the maintenance as accessing the reject chamber has been possible only by significant disassembly work of the screen, or in a repair facility, in which case the whole screen has been replaced for the repair work.

An object of the invention is to create a screen in which the disadvantages and problems of prior art are eliminated or at least minimized.

In particular an object of the invention is to create an improved screen with an improved rejects chamber, especially in view of the repair work needed due to wear of the rejects chamber.

SUMMARY OF THE INVENTION

According to an advantageous aspect of the invention the rejects chamber of the screen within a cover is removable from the screen housing by reopenable attachment means such as bolts which mount the cover to the screen housing. The cover is advantageously a cast dished design, that is a plate having an inwardly facing concavity, having a flange mount, to facilitate replacement in the field. Thus, the cover with rejects chamber of the screen can be removed in the field and replaced, which significantly decreases the time of the shutdown of the process and additionally offers longer lifetime of the screen in general as well as greater safety of the equipment. Advantageously, the attachment means comprise removable external, more advantageously threaded, fasteners mounted in openings, advantageously threaded, in the housing of the screen and the cover. Additionally, the attachment means advantageously has a piloted fit (a rabbet) in order to maintain alignment of the cover and the rejects chamber with the housing and the rest of the screen, when attached. Thus, openability of the rejects chamber is achieved by removing external fasteners from the cover openings.

According to an advantageous aspect of the invention the rejects chamber of the screen comprises at least one hydrodynamic anti-wear vane attached on an inner wall of the rejects chamber at a distance from the light rejects outlet. The hydrodynamic anti-wear vane/-s guide the flow inside the rejects chamber hydrodynamically such that the particles of the reject flow causing wear are guided off from that/those surface part/-s that are susceptible to wear. The hydrodynamic anti-wear vanes cause the reject flow to act in a more laminar fashion through the rejects chamber diameter. Advantageously, more than one hydrodynamic anti-wear vane is provided located at a radial distance from each other on the inner wall of the rejects chamber. Advantageously, four hydrodynamic anti-wear vanes are provided located at even radial distances from each other along the inner circumference of the rejects chamber, preferably welded in place. Advantageously, the material of the hydrodynamic vane is duplex stainless, high anti-wear stainless steel.

According to an advantageous aspect of the invention the rejects chamber of the screen comprises at least one surface in an immediate vicinity of the light rejects outlet provided with a wear resistance coating. Now it has been surprisingly found that when at least one surface of the reject chamber in an immediate vicinity of the light rejects outlet is provided with a wear resistance coating it is possible to significantly reduce the wear of the rejects chamber of the screen. It was highly unexpected that the wear resistance coating, even when applied on a relatively restricted area and location, was able to decrease the wear of the rejects chamber, at the rather harsh conditions which exist at the light rejects outlet, especially when screening pulp with recycled fiber material.

According to one advantageous aspect of the invention the internal surface of the cover of the reject chamber is at least partly provided with the wear resistance coating. Preferably the internal surface of the reject chamber is provided with the wear resistance coating at the light rejects outlet and in the immediate vicinity of it. In this manner the wear of the reject chamber, as well as the risk of breakage of the screen due to wear of the reject chamber can be minimized.

The invention is especially useful when the stock to be screened is of recycled fiber material, which brings a challenge of wear of equipment.

By the invention and its advantageous features several advantages are achieved: The rejects chamber of the screen can be removed in the field and replaced, which significantly decreases the time of the shutdown of the process and additionally, longer lifetime of the screen is achieved in general as well as greater safety of equipment. The rejects chamber of the screen is less susceptible to wear due to the advantageous hydrodynamic anti-wear vanes and/or the wear resistance coating. Additionally, an increase in hydraulic efficiency of the screen is achieved as the light reject outlet of the rejects chamber is advantageously positioned in the optimum location for the least resistance to flow. The efficiency of the screen is further improved by the hydrodynamic anti-wear vanes maintaining more laminar flow through the rejects chamber diameter.

BRIEF DESCRIPTION OF THE DRAWINGS

Aspects of the invention, however, together with additional objects and advantages thereof, will be best understood from the following description of some example embodiments when read in connection with the accompanying drawings and in the following the invention is described in more detail referring to the accompanying drawings.

DESCRIPTION OF THE PREFERRED EMBODIMENTS

During the course of this description like numbers and signs will be used to identify like elements according to the different views which illustrate the invention. Repetition of some reference signs may have been omitted in the figures for clarity reasons.

Figure 1:
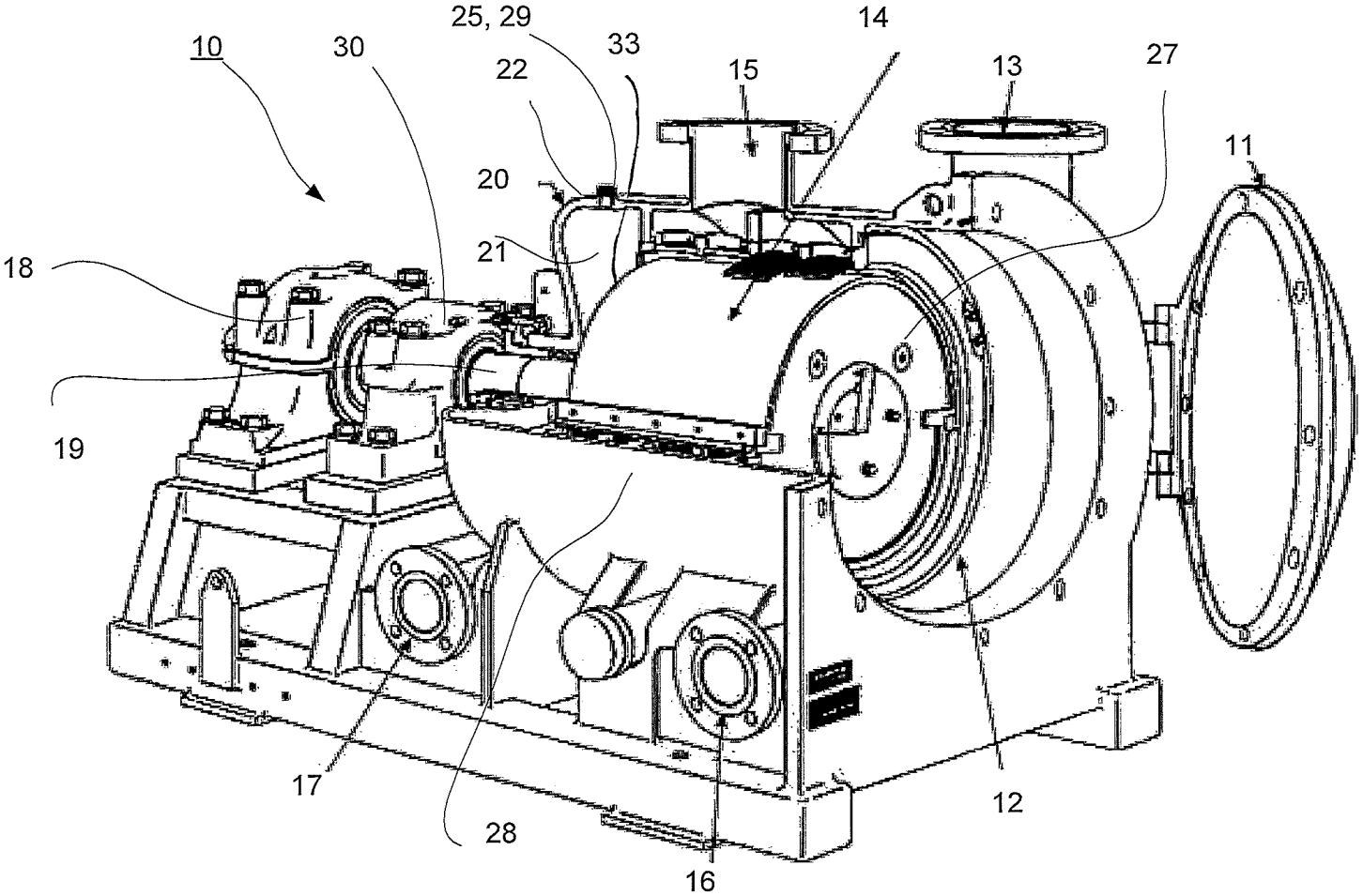
FIG. 1 is a perspective view, partially broken away in section, of an advantageous example of a screen according to the invention.
Figure 2:
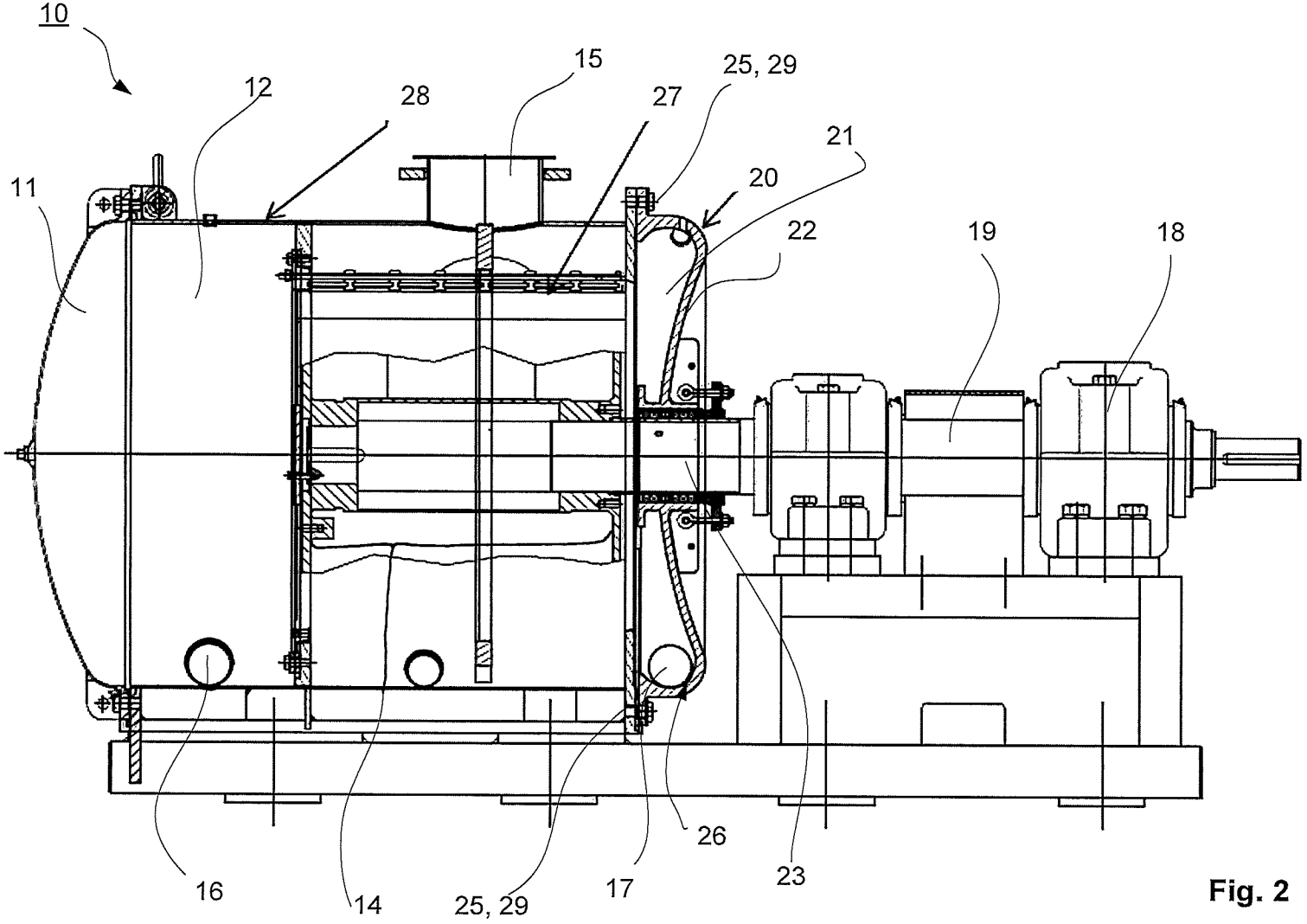
FIG. 2 is a side view, partially broken away in section of another advantageous example of a screen according to the invention.

In FIG. 1 is schematically shown an advantageous example of a screen 10, in which stock flow is from the inner diameter to the outer diameter of a basket 33 of the screen 10 and a rotor 27 is used to fluidize the pulp slurry on the inner diameter of the basket. The internal shell of the screen 10 has three functional zones: inlet zone 12, basket and accept zone 14 and reject zone 20. Power for the screen 10 is provided from a motor 18 via a shaft 19. The screen 10 comprises a housing 28 which receives the rotor 27 therein. The rotor has replaceable wear bars to fluidize the pulp slurry. The rotor 27 is overhung on the shaft 19, which extends through the rear of the screen 10 and into the housing 28. The shaft 19 is supported at the rear of the screen 10 by bearings 30. The screen 10 is advantageously equipped with a replaceable seal assembly located at the rear of the screen 10 where the shaft 19 passes through the screen shell. The screen 10 has a fabricated assembly. All parts in contact with stock are advantageously constructed of stainless steel. Access to the internals of the screen 10 is made through a hinged (bolted) access door 11. The screen 10 is designed with a horizontally mounted rotating assembly. The inlet 13 and accepts outlet 15 of the screen 10 are vertical. The heavy rejects outlet 16 and light rejects outlet 17 are, in the example of FIG. 1, located on the left-hand side of the screen 10 when viewed from the access door 11. In the inlet zone 12 heavy tramp material is removed prior to the screening of the pulp slurry. The inlet zone 12 is provided with the access door 11 for maintenance. The pulp slurry enters at the front top of the screen 10 through the tangentially mounted inlet 13. The stock flows in a clockwise direction, as viewed from the front, as it enters the inlet zone. Heavy rejectable material moves to the outside of the screen shell by centrifugal force. A junk trap is located in the inlet zone, to collect and isolate tramp material from the rotating assembly. Collected tramp material is removed through periodic cycling of a heavy rejects valve located in connection with the heavy rejects outlet 16. By means of the differential pressure between the interior of the screen 10 and the basket and the accepts zone 14 in the cover 22, the acceptable fibers are passed through the screen basket 33 and into the accept zone part of the basket and the accept zone 14 and accepted fibers are discharged through the accepts outlet 15 located midway on the screen basket of the basket and accepts zone 14. A rejects chamber 21 is formed by the cover 22 to provide the reject zone 20. The light reject outlet 17 of the rejects chamber 21, in the embodiment of FIG. 2, is advantageously positioned in the optimum location for the least resistance to flow. Light rejects will be discharged through the light reject outlet 17 of the rejects chamber 21 and heavy rejects will be discharged through a heavy rejects outlet 16 in the housing 28. The fiber mat, which forms over the screen basket, is re-fluidized with the pulsation generated by the rotor 27. The cover 22 with the reject chamber 21 is located at the rear of the screen 10. Material which does not pass through the screen basket will be discharged through the light rejects outlet 17 therefrom. The cover 22 is attached removably by attachment means to the housing 28 of the screen 10. The attachment means comprise removable external, more advantageously threaded, fasteners 29 mounted on openings 25, advantageously threaded, in the housing 28 of the screen and the cover 22 which forms the rejects chamber 21. Additionally, as shown in FIG. 2, the attachment means 25, 29 advantageously has a piloted fit (a rabbet) in order to maintain alignment of the cover 22 and the rejects chamber 21 with the housing 28 and the rest of the screen 10, when attached.

In FIG. 2 is schematically shown an advantageous example of a screen 10, in which stock flow is from the inner diameter to the outer diameter of a basket 33 of the screen 10 and a rotor 27 is used to fluidize the pulp slurry on the inner diameter of the basket formed inside a housing 28 of the screen 10. The internal shell of the screen 10 has three functional zones: an inlet zone 12, a basket and accept zone 14 and a reject zone 20. Power for the screen 10 is provided from a motor 18 via a shaft 19. The screen 10 comprises a housing 28 containing a rotor within which has replaceable wear bars located to fluidize the pulp slurry. The rotor 27 is overhung on the shaft 19, which extends through the rear of the screen 10. The shaft 19 is supported at the rear of the screen 10 by bearings 30. The screen 10 is advantageously equipped with a replaceable seal assembly located at the rear of the screen 10 where the shaft 19 passes through the screen shell. The screen 10 consists of a fabricated assembly. All parts in contact with stock are advantageously constructed of stainless steel. Access to the internals of the screen 10 is made through a hinged (bolted) access door 11. The screen 10 is designed with a horizontally mounted rotating assembly. The inlet and accepts outlet 13, 15 of the screen 10 are vertical. The heavy rejects and light rejects, outlets 16, 17 are in the example of the FIG. 2 located on the right-hand side of the screen 10 when viewed from the access door 11. In the inlet zone 12 heavy tramp material is removed prior to the screening of the pulp slurry. The inlet zone 12 is provided with the access door 11 for maintenance. The pulp slurry enters at the front top of the screen 10 through the tangentially mounted inlet 13. The stock flows in a clockwise direction, as viewed from the front, as it enters the inlet zone. Heavy rejectable material moves to the outside of the screen by centrifugal force. A junk trap is located in the inlet zone, to collect and isolate tramp material from the rotating assembly. Collected tramp material is removed through periodic cycling of the heavy rejects valve from the fiber slurry entering the screening in the basket and accept zone 14 via the inlet 13. By means of the differential pressure between the interior of the screen 10 and the basket and accepts zone 14 the acceptable fibers are passed through a screen basket 33 and into the accept zone part of the basket and the accept zone 14 and accepted fibers are discharged through the accepts outlet 15 located midway on the screen basket of the basket and accepts zone 14. Light rejects will be discharged through the light reject outlet 17 and heavy rejects will be discharged through a heavy rejects outlet 16. The fiber mat which forms over the screen basket is re-fluidized with the pulsation generated by the rotor 27. The reject zone 20 is located at the rear of the screen 10. Material which does not pass through the screen basket will be discharged through the light rejects outlet 17 therefrom. The rejects zone 20 is defined within a cover 22 which forms the rejects chamber 21. The cover 22 has a shaft opening for the shaft 19. The rejects chamber 21 within the cover of the screen 10 is removable by reopenable attachment means mounted in a cast dished design cover, the dished design is such that the cover is a rounded plate having an inwardly facing concavity, with a mounted flange, to facilitate replacement in the field. The cover 22 is attached removably by attachment means 25, 29 to the housing 28 of the screen 10. The attachment means 25, 29 comprise removable external, more advantageously threaded, fasteners 29 mounted on openings 25, advantageously threaded, in the housing 28 of the screen and the cover 20. The openings 25 are arranged spaced apart along the circumference of the housing 28 and the cover 22, advantageously to corresponding flange part 37 of the housing 28 and flange part 39 of the cover 20. The fasteners 29 are removably fastened through the openings 25 in the flange parts 37, 39. Preferably, the fasteners 29 are threaded and the openings 25 have respective threads. Additionally, the attachment means 25, 29 advantageously has a piloted fit (a rabbet) in order to maintain alignment of the cover 22 and the rejects chamber 21 with the housing 28 and the rest of the screen 10, when attached. The cover 22 with the rejects chamber 21 has at least one interior surface in an immediate vicinity of the light rejects outlet 17 provided with a wear resistance coating 26 i.e. a hard facing.

Figure 3B:
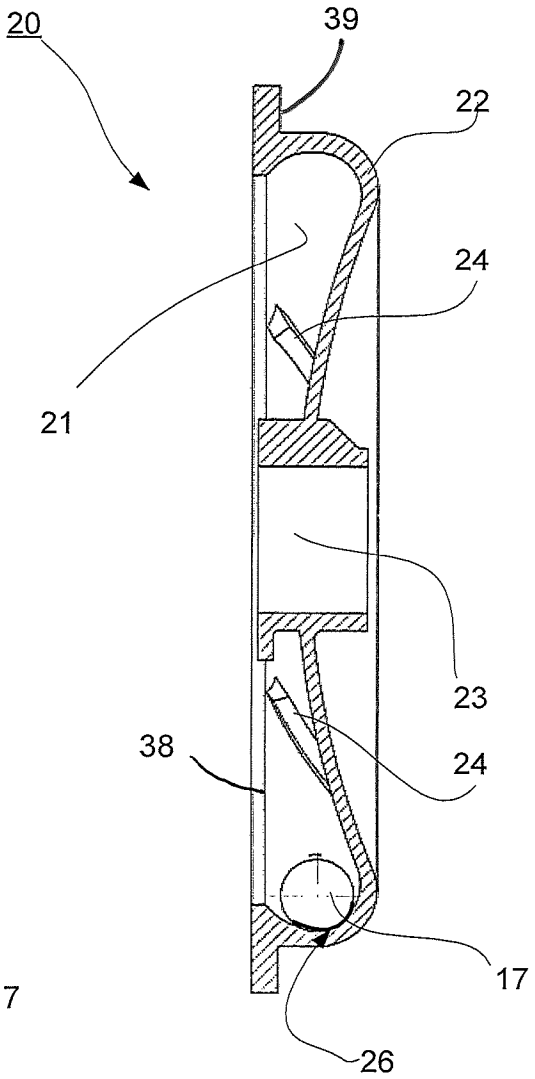
FIG. 3B is a cross-sectional view of the apparatus of FIG. 3A.
Figure 3A:
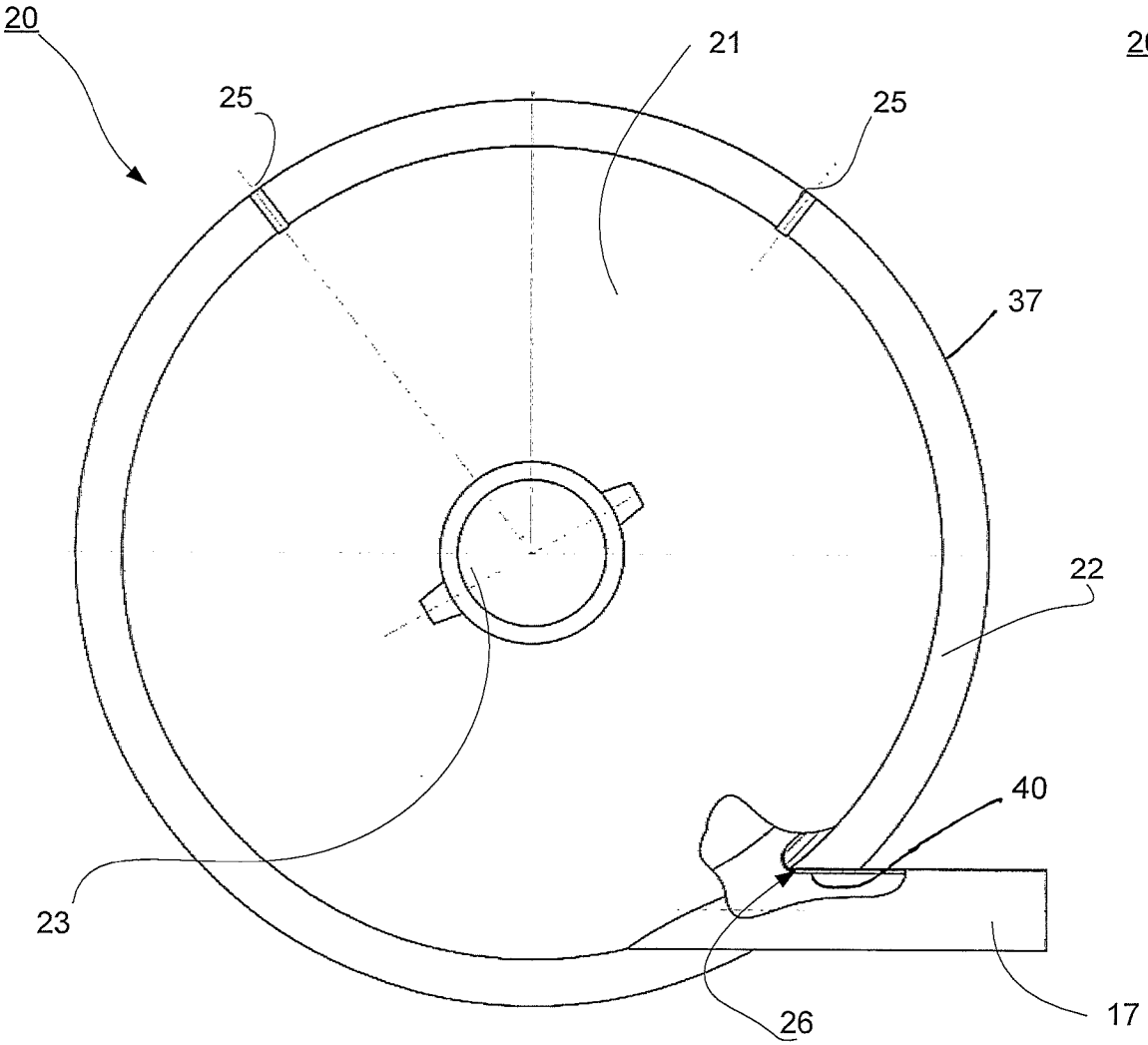
FIG. 3A is an end view of a rejects zone of a screen according to the invention.

In FIGS. 3A-3B is very schematically shown an advantageous example of the cover 22 with the rejects zone 20 of the screen 10. The rejects zone 20 is defined within the cover 22 which forms the rejects chamber 21. The cover 22 has a shaft opening 23 for the shaft 19 (such as shown in FIG. 1). The rejects chamber 21 of the screen 10 is removable by reopenable attachment means which mounted the cast dished design and flange-mounted cover 22, to facilitate replacement in the field. The attachment means for the flange are located in bolt openings 25. The rejects chamber 21 of the screen 10 comprises at least one hydrodynamic anti-wear vane 24 attached on an inner wall 38 of the cover 22 at a distance from the light rejects outlet 17. The hydrodynamic anti-wear vanes 24 guide the flow inside the rejects chamber 21 hydrodynamically such that the particles of the reject flow causing wear are guided off from those surface parts that are susceptible to wear. Advantageously, more than one hydrodynamic anti-wear vane 24 is provided located at a radial distance from each other on the inner wall 38 of the cover 22 forming the rejects chamber 21. The cover 22 with the rejects chamber 21 has at least one surface in an immediate vicinity of the light rejects outlet 17 provided with a wear resistance coating 26, i.e. a hard facing.

As can be seen from the examples shown in the figures, the cover 22 with the rejects chamber 21 of the screen 10 is removable by operation of the reopenable attachment means which mounts a cast dished design and flange mounted, to facilitate replacement in the field. The cast cover is a rounded plate having an inwardly facing concavity. The cover 20 is attached removably by the attachment means 25, 29 to the housing 28 of the screen 10. The attachment means 25, 29 comprise removable external, more advantageously threaded, fasteners 29 mounted to extend through openings 25, advantageously threaded, in the housing 28 of the screen and the cover 20 forming the rejects chamber 21. The openings 25 are arranged spaced apart along the circumference of the housing 28 and the cover 22, advantageously to corresponding flange parts 37, 39. The fasteners 29 are to be mounted through the openings 25 removably. Preferably, the fasteners 29, such as shown in FIG. 2, are threaded and the openings 25 have respective threads. Additionally, the attachment means 25, 29 advantageously has a piloted fit (a rabbet) in order to maintain alignment of the cover 22 and the rejects chamber 21 with the housing 28 and the rest of the screen 10, when attached.

As can be seen from the examples of FIGS. 2 and 3A-3B the rejects chamber 21 of the screen 10 comprises at least one surface in an immediate vicinity of the light rejects outlet provided with a wear resistance coating 26 i.e. a hard facing. The internal surface 38 of the cover 22 of the reject chamber 21 is at least partly provided with the wear resistance coating 26. Preferably the internal surface 38 of the reject chamber 21 is provided with the wear resistance coating 27 at the light rejects outlet 27 and in the immediate vicinity of it. The wear resistance coating 26 may be applied on a surface, which is in the immediate vicinity of the light rejects outlet 17 of the reject chamber 26 of the screen 10. Additionally, the wear resistance coating may be provided on a surface of the reject chamber 21 forming an inner surface 40 of the outlet channel 17 for the light rejects.

The wear resistance coating may be applied on a surface which is in the immediate vicinity of the light rejects outlet of the reject chamber of the screen. Additionally, the wear resistance coating may be provided on a surface of the reject chamber forming an inner surface of a flow channel for the light rejects.

According to one preferable embodiment the wear resistance coating may be provided during a maintenance shutdown of the manufacture of paper, board, or the like.

The wear resistance coating may be in the form of solution, emulsion, or dispersion when it is applied on the surface to be coated. Alternatively, the wear resistance coating may be in the form of a powder comprising discrete particles, which are applied on the surface and attached to the surface, e.g. by melting. According to yet another alternative, the wear resistance coating is in the form of a continuous coating foil or film. The composition may be applied on the cleaned surface by spraying, pasting, spreading or by attaching the coating foil or film on the surface, for example by using curable adhesive.

According to one embodiment of the invention the wear resistance coating has a coating thickness of at least 100 μm, in particular when thermal spraying is used as the coating process. According to one embodiment of the invention the wear resistance coating has a coating thickness of several millimeters, in particular when arc and laser welding is used as the coating process. The coating thickness of the wear resistance coating is preferably so thin that it does not disturb the flow patterns in the vicinity of the light rejects outlet. The coating thickness of the wear resistance coating is selected to provide a uniform coating layer which effectively protects the surface from wear.

The wear resistance coating is advantageously of metallic, ceramic or cermet material having good wear properties. Preferably, the wear resistance coating is applied by arc welding, laser welding or thermal spraying (Plasma, HVOF (High Velocity Oxygen Fuel), HVAF (High Velocity Air-Fuel), Arc Spraying of Flame Spraying). Preferably the wear resistance coating is selected from a material alternatives group consisting of iron- or nickel-based alloys having hard carbides embedded in metal matrix (Arc and laser welding), oxide (typically Al or Cr) ceramics (Thermal Spraying) or Tungsten- or Chromium-based carbides (Thermal spraying).

In the description in the foregoing, although some functions and elements have been described with reference to certain features, those functions and elements may be performable by other features whether described or not. Although features have been described with reference to certain embodiments or examples, those features may also be present in other embodiments or examples whether described or not. Above the invention has been described by referring to some advantageous examples only to which the invention is not to be narrowly limited. Many modifications and alterations are possible within the invention as defined in the following claims.

We claim:

1. A screen comprising:

an inlet zone, a basket and accept zone and a reject zone, which screen further comprises a housing, inside which a rotor is located, wherein the reject zone of the screen comprises a cover forming a rejects chamber for the reject zone and wherein the cover of the rejects chamber of the screen is removable by a reopenable attachment means attached to the housing of the screen, wherein the cover is of cast material, and having an inwardly facing concavity facing towards the accept zone, and wherein the cover has a mounting flange extending therefrom.

2. The screen of claim 1 wherein the rejects chamber of the screen comprises at least one surface provided with a wear resistance coating.

3. The screen of claim 2 wherein the rejects chamber comprises a first rejects outlet and wherein the at least one surface provided with the wear resistance coating is located in an immediate vicinity of the first rejects outlet.

4. The screen of claim 2 wherein the wear resistance coating is applied by arc welding, laser welding or thermal spraying (Plasma, HVOF (High Velocity Oxygen Fuel), HVAF (High Velocity Air-Fuel), Arc Spraying of Flame Spraying).

5. The screen of claim 2 wherein the wear resistance coating is comprised of a material selected from a material alternatives group consisting of iron- or nickel-based alloys having hard carbides embedded in metal matrix (Arc and laser welding), oxide ceramics or Tungsten- or Chromium-based carbides.

6. The screen of claim 2 wherein the wear resistance coating has a coating thickness of at least 100 μm.

7. The screen of claim 1 wherein the attachment means comprise openings and fasteners extending through the openings.

8. The screen of claim 7, wherein the openings are spaced apart along a circumference of the housing and the cover is removably fastened to the housing by the fasteners which extend through the openings.

9. The screen of claim 1 wherein the attachment means has a piloted fit (a rabbet).

10. A screen comprising:

an inlet zone, a basket and accept zone and a reject zone, which screen further comprises a housing, inside which a rotor is located, wherein the reject zone of the screen comprises a cover forming a rejects chamber for the reject zone and wherein the cover of the rejects chamber of the screen is removable by a reopenable attachment means attached to the housing of the screen, wherein the rejects chamber of the screen further comprises at least one hydrodynamic anti-wear vane.

11. The screen of claim 10 wherein the rejects chamber further comprises a first rejects outlet and the at least one hydrodynamic anti-wear vane is located at a distance from the first rejects outlet.

12. A pressure screen for use in a fiber web product process, the pressure screen comprising:

a housing;

a motor having a shaft which extends into the housing and supports a rotor within the housing for rotatable motion;

a basket mounted to the shaft within the housing, having portions defining an accept zone;

an inlet zone defined at a front of the housing; and a cover mounted to the housing and having portions which define a reject zone in communication with the accept zone, wherein the cover has portions defining a rejects chamber in the reject zone, and wherein a first rejects outlet receives material from the rejects chamber for the passage of light a first rejects out of the screen and wherein the cover is removably fastened to the housing.

13. The screen of claim 10, wherein the cover is of cast material, and having an inwardly facing concavity facing towards the accept zone, and where the cover has a mounting flange extending therefrom.

14. The pressure screen for use in a fiber web product process of claim 12 wherein the rejects chamber of the cover has portions defining an inner wall, portions of which are provided with a wear resistance coating.

15. The pressure screen for use in a fiber web product process of claim 14 wherein the portions of the inner wall provided with the wear resistance coating is located in an immediate vicinity of the first rejects outlet.

16. The pressure screen for use in a fiber web product process of claim 15 wherein the wear resistance coating is comprised of a material selected from a group consisting of iron- or nickel-based alloys having hard carbides embedded in metal matrix, and oxide ceramics or Tungsten- or Chromium-based carbides.

17. The pressure screen for use in a fiber web product process of claim 12 wherein the cover has a flange and the housing has a flange, and wherein the cover is removably attached to the housing by fasteners which extend through aligned openings formed in the flange of the cover and the flange of the housing.

18. The pressure screen for use in a fiber web product process of claim 12 wherein the cover has a flange which has a piloted fit with the housing defined by a rabbet.

19. The pressure screen for use in a fiber web product process of claim 12 wherein at least one hydrodynamic anti-wear vane is fixed to the cover within the rejects chamber spaced from the first rejects outlet.

* * * * *